United States Patent [19]

Trupp

[11] 4,051,808

[45] Oct. 4, 1977

[54] PAINT AND STAIN SHIELD

[76] Inventor: William Trupp, 901 Sandy Lane, Gastonia, N.C. 28052

[21] Appl. No.: 776,526

[22] Filed: Mar. 11, 1977

[51] Int. Cl.[2] ..... B05C 11/00

[52] U.S. Cl. ..... 118/504

[58] Field of Search ..... 118/504, 505; 15/256.5

[56] References Cited

U.S. PATENT DOCUMENTS

| | | | |
|---|---|---|---|
| 1,386,706 | 8/1921 | Hall | 118/504 |
| 1,411,462 | 4/1922 | Wendt | 118/504 |
| 2,476,509 | 7/1949 | Reimcke | 118/504 |
| 2,482,977 | 9/1949 | Hendrick | 118/505 |
| 3,536,041 | 10/1970 | Hill | 118/504 |
| 3,633,542 | 1/1972 | Read | 118/505 |
| 3,693,589 | 9/1972 | Knox | 118/504 |
| 3,788,274 | 1/1974 | McNaughton et al. | 118/504 |

FOREIGN PATENT DOCUMENTS

| | | | |
|---|---|---|---|
| 1,400,406 | 7/1975 | United Kingdom | 118/504 |

*Primary Examiner*—Mervin Stein
*Assistant Examiner*—A. M. Falik
*Attorney, Agent, or Firm*—Kile, Gholz, Bernstein & Georges

[57] ABSTRACT

A paint shield for shielding the edges of carpets or the like while painting the bottoms of the adjoining walls. The paint shield is formed in four substantially rectangular, substantially planar parts from a single piece of sheet-like material, such as galvanized metal, aluminum, plastic, fiberglass, bakelite, hard rubber, etc.

6 Claims, 4 Drawing Figures

PAINT AND STAIN SHIELD

BACKGROUND OF THE INVENTION

Paint shields for shielding the edges of carpets or the like while painting the bottoms of the adjoining walls are well-known and are shown, for instance in U.S. Pat. Nos. 3,693,589 to Knox and 3,788,274 to McNaughton et al. The prior art paint shields known to me, however, are all designed so that during the use of the shield, a relatively large portion of the shield comes into contact with the carpet, which causes a very perceptible and irritating drag as the paint shield is moved from place to place along the juncture line between a carpet and the bottom of the adjoining wall. Additionally, such paint shields are divided into two classes: those that have no handles and those which have handles which cause the paint shield to have an overly high profile. The former are difficult to manipulate, and the latter make it difficult to paint on the opposite side of the handle from the painting hand and do not permit painting under many cabinets or bookshelves that have a low overhang (for instance, three or four inches) above the carpet.

The problems suggested in the preceding are not intended to be exhaustive, but rather are among many which tend to reduce the effectiveness of prior paint shields of this general type. Other noteworthy problems may also exist; however, those outlined above should be sufficient to demonstrate that such paint shields have not been altogether satisfactory.

OBJECTS OF THE INVENTION

It is, therefore, a general object of the invention to provide a paint shield for shielding the edges of carpets or the like while painting the bottoms of the adjoining walls which will obviate or minimize problems of the type previously described.

It is a particular object of the invention to provide such a paint shield which minimizes the drag as the paint shield is moved from place to place along the juncture line between a carpet and the bottom of the adjoining wall.

It is a further object of the invention to provide such a paint shield which has a handle, yet has a profile low enough to permit the user of the paint shield to paint easily on the opposite sides of the handle from his painting hand and to permit him to paint under cabinets, bookshelves or the like, which have overhangs as low as three or four inches above the carpet.

Other objects and advantages of the present invention will become apparent from the following detailed description of a preferred embodiment thereof taken in conjunction with the accompanying drawings.

DETAILED DESCRIPTION OF THE PREFERRED EMBODIMENT

Figure 3:
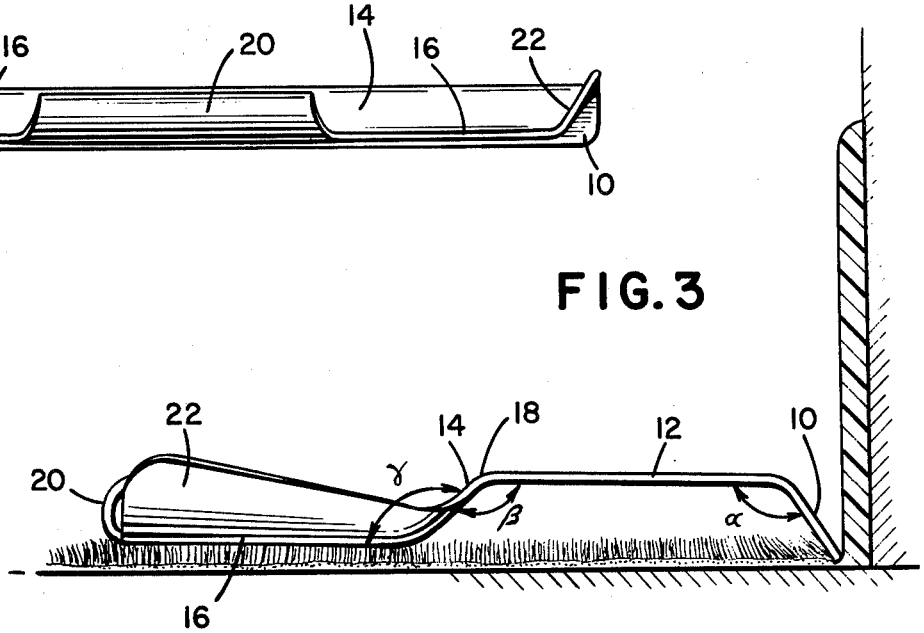
FIG. 3 is a side view of the presently preferred embodiment of the subject invention, showing it in use.
Figure 4:
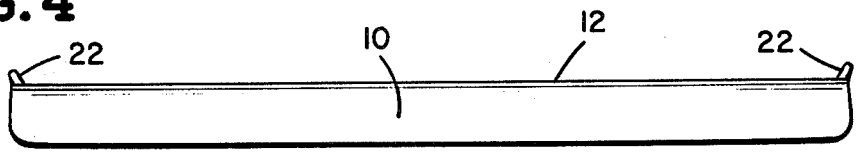
FIG. 4 is a frontal view of the presently preferred embodiment of the subject invention.

Referring now to the drawings, the presently preferred embodiment of the subject invention comprises a substantially planar and substantially rectangular lip portion 10 of sheet-like material, a substantially planar and substantially rectangular bridge portion 12 of sheet-like material extending from the lip portion 10 along one of its long edges, a substantially planar and substantially rectangular reflex portion 14 of sheet-like material extending from the bridge portion 12 along the arc of its edges opposite to the edge adjoining the lip portion 10, and a substantially planar and substantially rectangular handle portion 16 of sheet-like material extending from the reflex portion 14 along the arc of its edges opposite to the edge adjoining the bridge portion 12. As best seen in FIG. 3, the angles between the lip portion 10 and the bridge portion 12, the bridge portion 12 and the reflex portion 14, and the reflex portion 14 and the handle portion 16 are such that, when the lip portion 10 is positioned between the edge of a carpet and the bottom of an adjoining wall, the line 18 joining the reflex portion 14 and the bridge portion 12 is close to, but does not touch, the carpet and no portion of the paint shield other than the lip portion 10 and the handle portion 16 touches the carpet. In particular, the angle $\alpha$ between the lip portion 10 and the bridge portion 12 is preferably between 90° and 180° and most preferably around 135°, the angle $\beta$ between the bridge portion 12 and the reflex portion 14 is preferably between 90° and 180°, most preferably around 135°, and of the same sense as the angle $\alpha$, and the angle $\gamma$ between the reflex portion 14 and the handle portion 16 is also preferably between 90° and 180°, most preferably around 135°, and the opposite sense to the angles $\alpha$ and $\beta$. As may be seen in FIG. 3, this configuration causes the lip portion 10, the bridge portion 12 and the reflex portion 14 to form a flared open trough looking downward during use of the paint shield, and it causes the bridge portion 12 and the handle 16 to be at least roughly parallel.

The lip portion 10, the bridge portion 12, the reflex portion 14 and the handle portion 16 are all preferably made from the same piece of sheet-like material. What that material is made of is of no particular significance so far as the present invention is concerned, but of course it should be relatively sturdy and impervious to paints and paint removers. In particular, aluminum, plastic, fiberglass, bakelite, hard rubber or sheet-metal may be used.

The subject paint shield preferably comprises a handle 20, although a hole may be cut through the handle portion 16 and the paint shield grasped directly by curling the fingers through the hole. If a handle is used, it should of course be a very low one, as illustrated in the drawings, to take advantage of the low profile of the portion 10-16. Moreover, since it is easier to sit or kneel to one side or the other of of the area to be painted than to paint from directly behind the paint shield, the handle 20 preferably comprises an upturned lip as shown, permitting the user to place his or her hand flat on the handle portion 16 and parallel to the handle 20. In this position, the user can exert downward pressure if necessary and can at the same tim push back on the handle to pull the carpet pile back.

Figure 1:
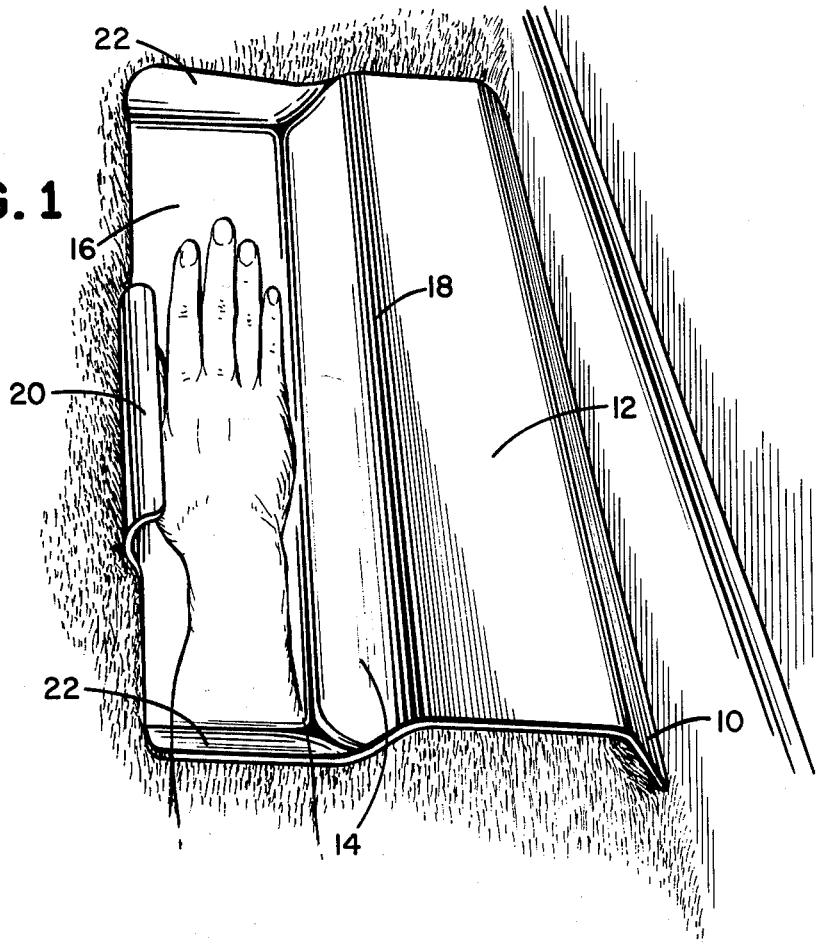
FIG. 1 is a perspective view of the presently preferred embodiment of the subject invention, showing it in use.
Figure 2:
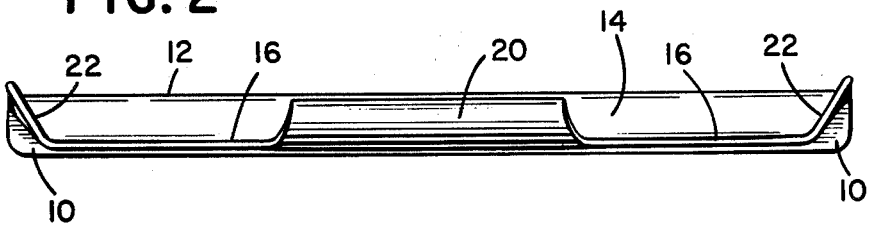
FIG. 2 is a rear view of the presently preferred embodiment of the subject invention.

The longitudinal edges 22 of the handle portion 16 are preferably curved upwards as best seen in FIG. 2 to enable the shield to slide easily without snagging the carpet. The curved lower surface of the stops 22 also enable the shield to slide easily without snagging the carpet.

ADVANTAGES OF THE INVENTION

From the foregoing description of a paint shield for shielding the edges of carpets or the like while painting the bottoms of adjoining walls in accordance with a preferred embodiment of the invention, those skilled in the art will recognize several advantages which singularly distinguish the subject invention from previously known devices. Some of the advantages are set forth below. However, while the following list of advantages is believed to be both accurate and representative, it does not purport to be exhaustive.

A particular advantage of the subject invention is that it minimizes the drag as the paint shield is moved from place to place along the juncture line between a carpet and the bottom of the adjoining wall.

A further advantage of the subject invention is that it has a handle, facilitating manipulation of the paint shield, yet has a profile low enough to permit the user to paint easily on the opposite side of the handle from his painting hand and to permit him to paint under cabinets, bookshelves or the like which have overhangs as low as three or four inches above the carpet.

Another advantage of the subject invention is that it can be manufactured simply and inexpensively from a minimum of parts, yet is sturdy and reliable in use.

Yet a further advantage of the subject invention is that it prevents over-reaching during painting.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A paint and stain shield for shielding the edges of carpets or the like while painting or staining the bottom of adjoining walls, said paint and stain shield comprising:

a. a substantially planar and substantially rectangular lip portion of sheet-like material, b. a substantially planar and substantially rectangular bridge portion of sheet-like material extending from said lip portion along one of the long edges thereof;

c. a substantially planar and substantially rectangular reflex portion of sheet-like material extending from said bridge portion along an edge opposite to the edge adjoining said lip portion; and d. a substantially planar and substantially rectangular handle portion of sheet-like material extending from said reflex portion along an edge opposite to the edge adjoining said bridge portion, the angles between said lip portion and said bridge portion, said bridge portion and said reflex portion, and said reflex portion and said handle portion being such that, when said lip portion is positioned between the edge of a carpet and the bottom of an adjoining wall, the line joining said reflex portion and said bridge portion is close to, but does not touch, the carpet and no portion of the paint shield other than said lip portion and said handle portion touches the carpet.

2. A paint shield as recited in claim 1 wherein the angle $\alpha$ between said lip portion and said bridge portion is between 90° and 180°, the angle $\beta$ between said bridge portion and said reflex portion is also between 90° and 180° and of the same sense as the angle $\alpha$, whereby said lip portion, said bridge portion and said reflex portion form a flared open trough looking downward during use of the paint shield, and angle $\gamma$ between said reflex portion and said handle portion is also between 90° and 180°, but of the opposite sense to the angle $\alpha$ and $\beta$, whereby said bridge portion and said handle portion are at least roughly parallel.

3. A paint shield as recited in claim 1 wherein said lip portion, said bridge portion, said reflex portion and said handle portion are all made from the same piece of sheet-like material.

4. A paint shield as recited in claim 1 and further comprising a handle carried by said handle portion.

5. A paint shield as recited in claim 4 wherein said handle comprises an upturned lip at the rear edge of said handle portion, whereby the user of the paint shield can place his or her hand flat on said handle portion and parallel to said handle.

6. A paint shield as recited in claim 1 wherein the longitudinal edges of said handle portion are curved upwards to enable the shield to slide easily without snagging the carpet.

* * * * *